US007266861B2

(12) United States Patent
Stein et al.

(10) Patent No.: US 7,266,861 B2
(45) Date of Patent: Sep. 11, 2007

(54) ADJUSTABLE BRUSH ROLLER ACCESSORY FOR VACUUM CLEANER OR THE LIKE

(75) Inventors: Thomas Stein, Velbert (DE); Andreas Laaser, Hattingen (DE)

(73) Assignee: Stein & Co. GmbH, Velbert (DE)

( * ) Notice: Subject to any disclaimer, the term of this patent is extended or adjusted under 35 U.S.C. 154(b) by 595 days.

(21) Appl. No.: 10/629,067

(22) Filed: Jul. 28, 2003

(65) Prior Publication Data

US 2004/0154114 A1 Aug. 12, 2004

(30) Foreign Application Priority Data

Feb. 7, 2003 (DE) ..... 103 05 276

(51) Int. Cl.
*A47L 5/34* (2006.01)

(52) U.S. Cl. ..... 15/359; 15/360; 15/371

(58) Field of Classification Search ..... None
See application file for complete search history.

(56) References Cited

U.S. PATENT DOCUMENTS 3,676,892 A * 7/1972 Nordeen ..... 15/359
5,522,114 A * 6/1996 Allison ..... 15/320
5,819,370 A 10/1998 Stein

FOREIGN PATENT DOCUMENTS

GB 2 047 081 11/1980

* cited by examiner

*Primary Examiner*—David Redding
(74) *Attorney, Agent, or Firm*—W. F. Fasse; W. G. Fasse

(57) ABSTRACT

A brush roller accessory for a vacuum cleaner includes a main support roller and a power-driven brush roller rotatably arranged in a housing, and a spring-biased adjusting roller that adjustably protrudes from the housing to bear some of the total contact force of the accessory against a floor, to reduce or relieve the contact force exerted by the brush roller against the floor. The adjusting roller is rotatably mounted on a pivot lever, having a first end pivotally connected to the housing and a second end connected to a spring that biases the lever to pivot the adjusting roller outwardly from the housing. A rotary knob with several stop surfaces selects an upper limit on the pivot range of the lever and the adjustment height of the adjusting roller. A coupling link pivots the adjusting roller to a maximally protruding position to lift the brush roller into a parking position.

17 Claims, 3 Drawing Sheets

ADJUSTABLE BRUSH ROLLER ACCESSORY FOR VACUUM CLEANER OR THE LIKE

PRIORITY CLAIM

This application is based on and claims the priority under 35 U.S.C. §119 of German Patent Application 103 05 276.3, filed on Feb. 7, 2003, the entire disclosure of which is incorporated herein by reference.

FIELD OF THE INVENTION

The invention relates to a brush roller accessory for a floor cleaning device, such as a vacuum cleaner. Such a brush roller accessory, also known as a brush head, a brush tool, a floor brush, or a power brush, includes a power-driven brush roller, and is embodied to be adjustable relative to the floor, such as a carpeted floor, on which it runs for cleaning the floor.

BACKGROUND INFORMATION

Various different configurations of brush roller accessories for vacuum cleaners or other floor cleaning devices are known in the art. Such brush roller accessories typically include a housing, one or more main support rollers or running rollers, or glide elements that roll or glide along the floor so as to support much of the weight of the accessory, as well as a power-driven brush roller that brushes the carpet or other floor surface in order to loosen or lift dust, dirt particles, and other soiling agents from the floor, so that these materials can be more effectively sucked away by the vacuum or suction air flow that is applied to the housing through a vacuum cleaner hose and wand assembly, for example.

It is known in the art to provide various mechanical arrangements, whereby the position of the brush roller relative to the floor, and particularly the downward protrusion of the brush roller, can be adjusted to adapt the brushing performance to different carpet pile heights or the like. Such stepped or fixed mechanical settings of the adjusted position of the brush roller are problematic, however, because they are subject to operator error in selecting the wrong adjustment height for the particular operating conditions, and because they do not provide an automatic or responsive adaptation to the prevailing conditions, such as the carpet pile height, the resiliency or cushioning effect of a carpet pad or the like arranged below the carpet, progressive wear of the bristles of the brush roller, and other operating conditions. Thus, such mechanical adjustments of the brush roller do not achieve a constant or responsively adapted contact force or pressure of the brush roller against the carpet or other floor surface being cleaned.

It is also known in the art to provide electrical or electronic adjustment mechanisms to carry out an adjustment of the brush roller so as to achieve a uniform contact or pressing force of the brush roller against the carpet or other floor surface, independent of the underlying floor surface conditions or other operating conditions. Such electrical and electronic adjustment mechanisms, however, are relatively complicated, costly, and prone to malfunction and breakdown.

SUMMARY OF THE INVENTION

In view of the above, it is an object of the invention to provide a mechanical adjusting mechanism for a brush roller accessory of a vacuum cleaner or the like, which is simple in construction, yet durable and robust, and effective in operation to achieve a uniform contact force of the brush roller against the floor being cleaned, so as to adapt to various different floor conditions. It is a further object of the invention to provide such an adjusting mechanism that offers a parking position for the brush roller, to relieve most or all of the contact force or pressure from the brush roller. The invention further aims to avoid or overcome the disadvantages of the prior art, and to achieve additional advantages, as apparent from the present specification.

The above objects have been achieved according to the invention in an adjustable brush roller accessory for a floor cleaning device such as a vacuum cleaner. The brush roller accessory comprises a housing, one or more running rollers or glide elements that are the main support elements for the housing on the floor, a power-driven rotatable brush roller, and an adjusting roller or glide element that is movably arranged with respect to the housing, with an adjustable protrusion height toward or away from the floor relative to the brush roller. Thereby, adjusting the height or position of the adjusting roller relative to the housing will adjust the contact pressure of the adjusting roller on the floor, which correspondingly adjusts the proportion of the total weight or contact force of the brush roller accessory on the floor that is exerted by the adjusting roller. This in turn inversely or oppositely influences the contact pressure of the brush roller on the floor. Considered differently, lowering the adjusting roller will effectively raise the brush roller or at least reduce the contact pressure of the brush roller, while raising the adjusting roller will lower the brush roller toward the floor or at least increase the contact pressure of the brush roller on the floor. Also, a spring-biased "floating" adjustability of the adjusting roller provides an adaptive variable adjustment of the contact pressure exerted by the adjusting roller, and thus of the contact pressure exerted by the brush roller against the floor.

More particularly according to the invention, the adjusting roller is adjustably mounted with respect to the housing by a pivoting mechanism including a rocker or pivot lever that has a pivot point at one end thereof pivotally connected to the housing, and a spring connected between the housing and a spring connection point on the pivot lever displaced away from the pivot point thereof. The adjusting roller or adjusting glide element is mounted on the pivot lever at a mounting point displaced away from the pivot point. The spring exerts a spring bias force on the pivot lever in a direction pivoting the lever so as to press the adjusting roller or adjusting glide element out of the housing toward the floor, so as to reduce the contact force of the brush roller against the floor.

With the inventive mechanism, it is possible to determine the contact force of the brush roller onto the underlying floor such as the carpet being cleaned. In this context, the adjusting roller is spring-loaded or pre-stressed by the spring force of the pivot spring acting on the pivot lever, so that the adjusting roller will always carry a corresponding portion (as determined by the spring characteristic and the lever characteristics) of the total contact forces of the brush roller accessory on the floor. Thereby, i.e. by taking up some of the contact forces, the adjusting roller will relieve and reduce the contact forces of the brush roller against the floor. In this manner it is possible to adjust the contact force that is taken over by the adjusting roller and also the contact force of the brush roller against the floor, nearly constantly over the entire adjusting travel distance of the adjusting roller.

According to an advantageous embodiment of the invention, the adjusting roller is rotatably mounted on or connected to the pivot lever at a location between the end at which the lever is pivot-connected to the housing and the spring connection point at which the spring is connected to the lever. This arrangement provides an increased leverage and effectiveness for the spring to act via the pivot lever on the adjusting roller.

In order to provide manually selectable pre-adjustments or limits on the adjusting and operating range of the adjusting roller, a further embodiment of the invention additionally comprises an adjustable limiting element allocated to and cooperating with the pivot lever. Particularly, this limiting element acts as a counter support or limiting stop for the pivot lever so as to achieve a manual height adjustment of the adjusting roller, while still allowing a spring-loaded "floating" of the adjusting roller within the range allowed by the selected adjustment of the limiting element. Preferably, the selectable counter support surfaces comprises support or stop surfaces that are connected to and movable by means of a rotary knob. Thus, by rotating the knob, any selected one of the stop surfaces can be moved into a position to limit the upward travel of the pivot lever. In this context, the several stop surfaces all extend parallel to, but respectively have different spacing distances away from the rotation axis of the rotary knob, so as to correspondingly allow the selection of different adjustment heights or adjustment height range limits.

According to another advantageous embodiment feature of the invention, it is possible to carry out pre-adjustments to actively push the pivot lever and therewith the adjusting roller in a direction protruding out away from the housing. Thereby, the adjusting roller can be pushed outwardly into a maximally protruding position so as to effectively lift the brush roller into a parking position that is retracted away from the floor, e.g. for storage of the accessory. Preferably, this is achieved by a controllable coupling link that is connected to the pivot lever at a location displaced away from the pivot point of the lever. This coupling link can be manually or automatically actuated by a suitable operating element. For example, the coupling link may be driven by a manually operable rotary knob, or can be automatically driven by a rotary device that rotates so as to push the coupling link as the housing of the brush roller accessory is tilted or pivoted into a non-use or storage position, e.g. relative to the wand of the vacuum cleaner that is coupled to the brush roller accessory. In this context, the coupling link may comprise a coupling rod element that is form-fittingly connected to the pivot lever, or may comprise a spring-loaded extensible rod or piston-cylinder device.

BRIEF DESCRIPTION OF THE DRAWINGS

In order that the invention may be clearly understood, it will be described below in connection with example embodiments, with reference to the accompanying drawings, wherein.

DETAILED DESCRIPTION OF PREFERRED EXAMPLE EMBODIMENTS AND OF THE BEST MODE OF THE INVENTION

Figure 1:
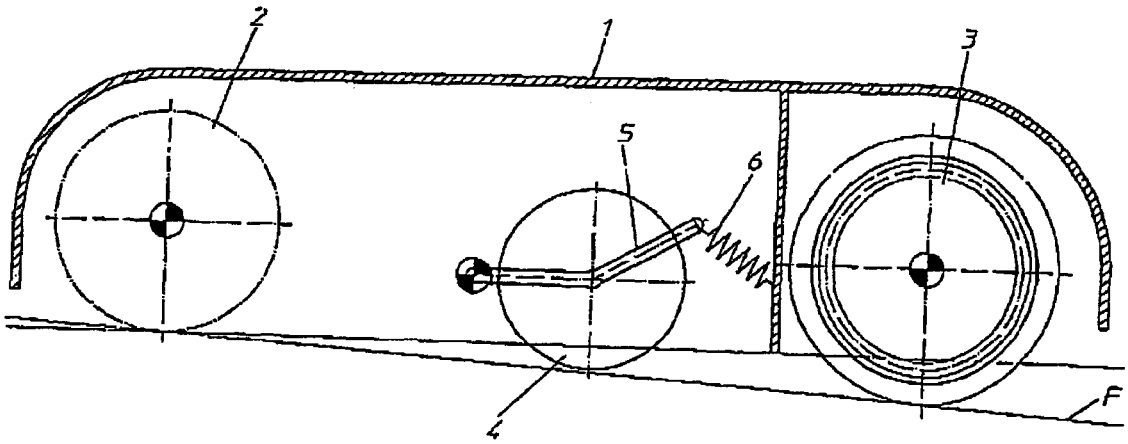
FIG. 1 is a schematic sectional side view of the principle components of an adjustable brush roller accessory according to the invention.
Figure 1A:
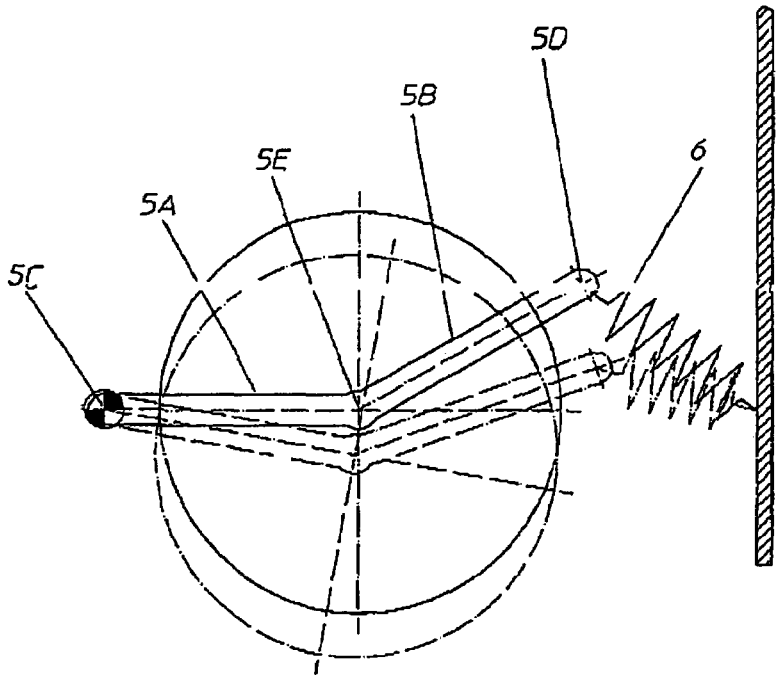
FIG. 1A is an enlarged detail portion of FIG. 1.

FIGS. 1 and 1A schematically illustrate the principle components of a brush roller accessory according to the invention, which is also known as a brush head, a brush tool, or a power brush for a vacuum cleaner or the like. The illustrated schematically simplified brush roller accessory comprises a housing 1, one or more main support or running rollers 2 rotatably mounted in the housing 1, a power-driven brush roller 3 that is also rotatably mounted in the housing 1, and an adjusting roller 4 that is also rotatably arranged in the housing 1. In this context, the main support roller or rollers 2 could be replaced by glide elements such as blocks of a low-friction plastic, and the adjusting roller or rollers 4 could be replaced by corresponding glide elements. In either case, the main support roller or glide element 2 is intended to support most of the weight and contact force of the overall brush roller accessory on the underlying floor F, which is a carpeted floor, for example. On the other hand, the adjusting roller or adjusting glide element 4 is intended to support a portion of the total weight or contact forces of the brush roller accessory on the floor F, to thereby relieve or reduce at least some of the contact force of the brush roller 3 pressing against the floor F.

The running roller 2 is arranged generally at the rear of the housing 1, for example at a rear end or portion of the housing 1 at which a vacuum cleaner wand or the like (not shown) can be coupled to the brush roller accessory. On the other hand, the brush roller 3 is arranged generally at the front end of the housing 1 opposite the running roller 2. The adjusting roller 4 is located between the running roller 2 and the brush roller 3, while being somewhat closer to the brush roller 3, so as to be able to relieve some of the contact force from the brush roller 3 as will be described below. The brush roller 3 is power-driven to rotate during the operation of the accessory, by any conventional drive arrangement such as an electric motor or an air turbine connected to the brush roller 3 through a drive belt or the like. Such a conventional drive arrangement is not shown, for simplicity in the drawing.

The adjusting roller 4 is adjustable with regard to its position in the housing or its protrusion from the housing. To achieve this, a pivot point at a first pivoting end 5C of a pivot lever 5 is pivotally connected to the housing 1, a pivot spring 6 is connected between the housing 1 and a spring connection point at the second free end 5D of the pivot lever 5, and the adjusting roller 4 is rotatably mounted on the pivot lever 5 at a mounting point displaced from the pivoted end 5C. While not visible in the drawings, it should be understood that the same arrangement of a pivot lever can be symmetrically provided on the other side, i.e. on opposite ends of the adjusting roller 4 so as to independently floatingly support the two opposite ends of the adjusting roller 4.

In the embodiment according to FIGS. 1 and 1A, the pivot lever 5 is a two-armed angled pivot lever including a first base arm 5A terminating at the pivoted end 5C, and a second free arm 5B terminating at the free end 5D, whereby these two arms 5A and 5B meet each other at an angle less than 180° and particularly an obtuse angle at a vertex 5E. In this embodiment, the adjusting roller 4 is rotatably mounted at the vertex 5E of the two-armed pivot lever 5. This arrangement provides a suitable working range for the spring 6, which may be embodied as a typical helical tension spring. Thereby, the spring 6 exerts a spring-loading bias force on the pivot lever 5, tending to pivot the lever 5 downwardly about the pivoted end 5C, while thereby pushing the adjusting roller 4 downwardly and outwardly to protrude out of the housing 1. As a result, the adjusting roller 4 presses against the underlying floor F with a contact force determined by the spring characteristic of the spring 6 and the particular configuration and dimensions of the pivot lever 5. Note that FIG. 1A shows two different "floating" adjusted positions of the adjusting roller 4 and the pivot lever 5 with corresponding ghost lines.

By taking up some of the total contact force, the adjusting roller 4 thereby correspondingly "lifts" the housing 1 and therewith the brush roller 3 in a direction away from the floor F, whereby the contact force of the brush roller 3 pressing against the floor F is reduced. Thus, by selecting the suitable spring 6 and the appropriate configuration of the pivot lever 5, the desired contact force of the brush roller 3 can be achieved and maintained essentially constant and uniform, independently of the varying characteristics of the floor F to be cleaned, the progressive wear of the brush roller 3, and other variable operating conditions. In this manner, the proper contact force of the brush roller 3 on the floor F for achieving the most effective cleaning and for reducing the wear of the carpeted floor F and of the brush roller 3 can be ensured.

Figure 2:
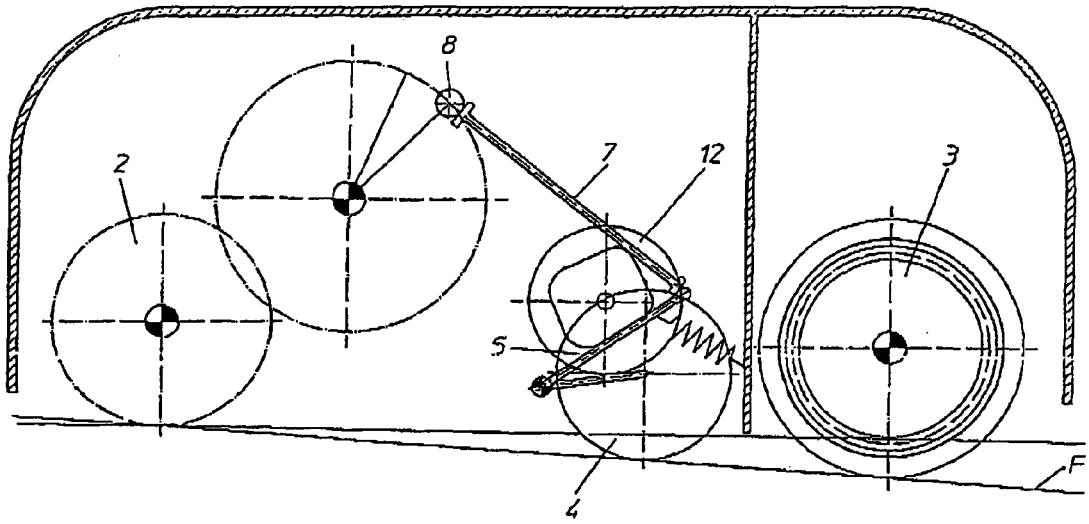
FIG. 2 is a schematic view similar to that of FIG. 1, but showing a further embodiment with an arrangement for pre-adjusting the adjusting roller and an additional operating element for selecting a parking position of the brush roller.
Figure 2A:
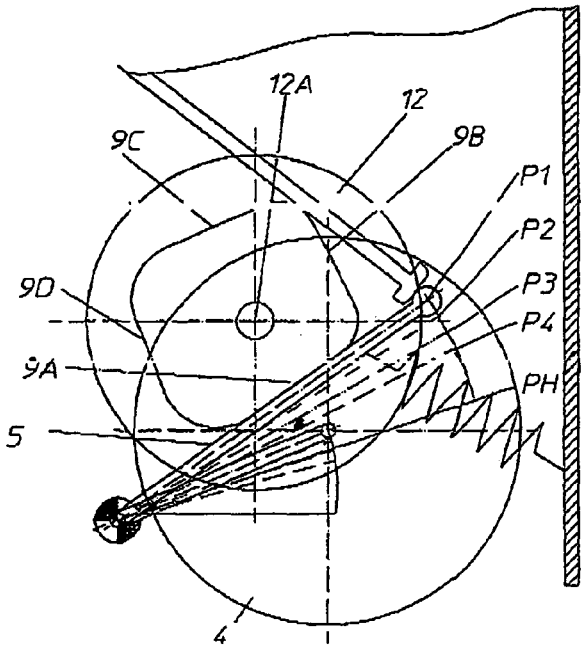
FIG. 2A is an enlarged detail portion of FIG. 2.

The embodiment of FIGS. 2 and 2A uses the same basic elements and principles of the embodiment of FIGS. 1 and 1A, but with a straight pivot lever 5. Here, the spring 6 is not connected to the free end of the straight pivot lever 5, but rather to a spring connection point displaced slightly from the free end toward the pivoted end of the pivot lever 5. The spring-loaded "floating" movement of the pivot lever 5 about its pivot point and therewith the corresponding adjustment of the adjusting roller 4 corresponds to the above discussion in connection with FIGS. 1 and 1A.

In order to additionally enable the manual selection or pre-adjustment of several adjustment ranges or positions P1, P2, P3 and P4 of the pivot lever 5 and therewith the adjusting roller 4, the embodiment of FIGS. 2 and 2A further comprises a rotary knob 12 that is rotatable about a rotation axis 12A in the housing 1, and several support or stop surfaces 9, for example four stop surfaces 9A, 9B, 9C and 9D, connected to the rotary knob 12 with respective different spacing distances between the respective stop surfaces 9 and the rotation axis 12A of the rotary knob 12. By rotating the rotary knob 12, it is possible to move a selected one of the stop surfaces 9A, 9B, 9C or 9D into a position in which it stops or limits the upward pivoting travel of the pivot lever 5 at the corresponding selected spacing distance away from the rotation axis 12A of the rotary knob 12 defined by the selected stop surface 9. In this manner, the rotary adjustment of the rotary knob 12 selectively pushes the adjusting roller 4 downwardly or outwardly away from the housing 1, and limits the upward travel or retraction of the adjusting roller 4 while still allowing the spring-loaded free-floating adjusting movement thereof in a range extending outwardly from the limited or stopped position P1, P2, P3 or P4 that has been selected and determined by the corresponding stop surface 9A, 9B, 9C or 9D of the rotary knob 12.

An additional feature is further incorporated into the embodiment of FIGS. 2 and 2A. Namely, a controllable coupling link 7 is connected between an operating element 8 and the pivot lever 5. Thereby, a rotational adjustment of the operating element 8 acts through the coupling link 7 to push or pivot the pivot lever 5 in a downward direction to protrudingly extend the adjusting roller 4. Particularly, the coupling link 7 can thereby adjust the pivot lever 5 into an enforced position PH providing a maximal protrusion of the adjusting roller 4, whereby the brush roller 3 is effectively lifted into a parking position with a minimized contact force or no contact force against the floor F. The operating element 8 can be actuated manually or automatically, for example by being coupled to a pivoting or tilting movement of the housing 1, for example relative to the vacuum cleaner wand, for setting the brush roller accessory into a storage position.

Figure 3:
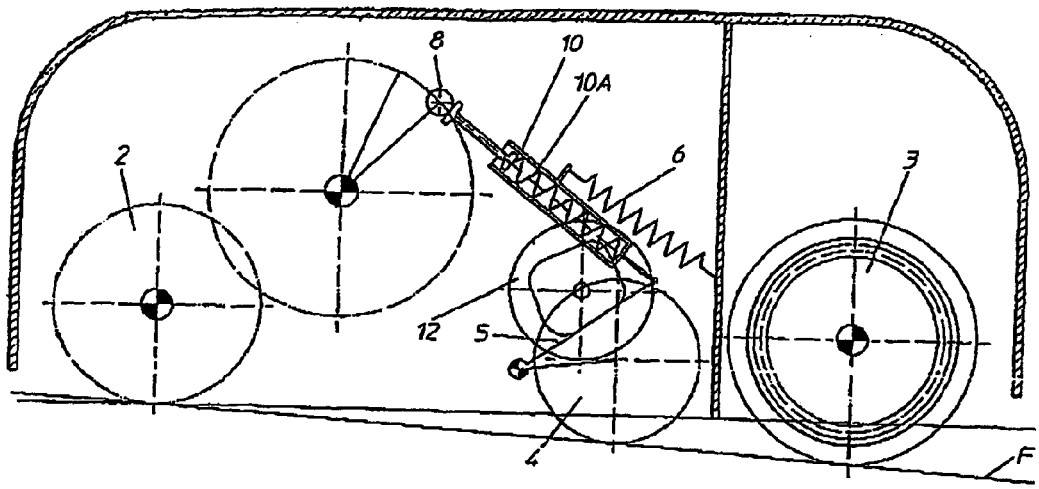
FIG. 3 is a schematic illustration similar to that of FIG. 2, but with a coupling link embodied as a spring-loaded rod or piston element.
Figure 3A:
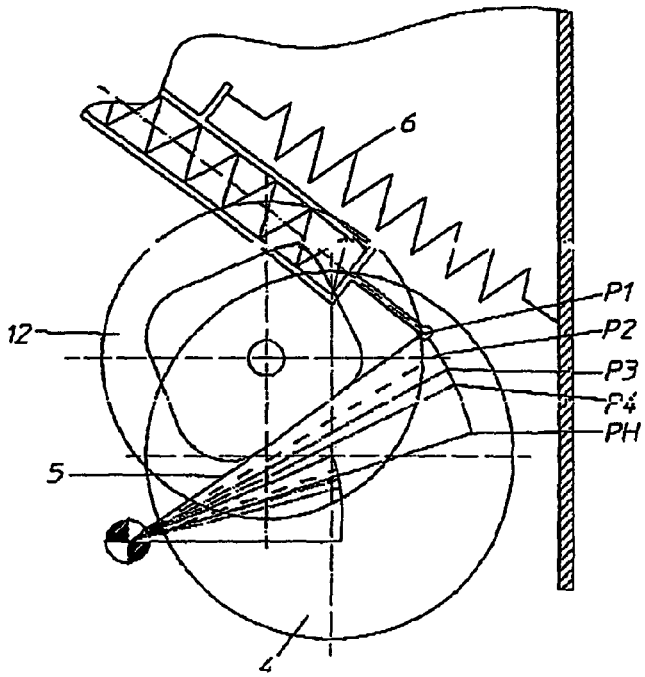
FIG. 3A is an enlarged detail portion of FIG. 3.

The embodiment of FIGS. 3 and 3A generally corresponds to that of FIGS. 2 and 2A, but the coupling link 7 for operating or actuating the pivot lever 5 is embodied as a spring-loaded extensible rod or piston-cylinder element 10 with an incorporated spring 10A. In this embodiment, the roller biasing spring 6 may be connected to the spring-loaded rod or piston-cylinder element 10. In this manner, the two springs 6 and 10A act in cooperation with one another to achieve a spring-loaded biasing and adjustment of the adjusting roller 4. Alternatively, the spring 6 could be connected directly to the pivot lever 5 as in the preceding embodiments, and would still achieve the same biasing effect. Namely, the spring 6 biases the pivot lever 5 relative to the housing 1, while the spring 10A biases the pivot lever 5 relative to the operating element 8.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A floor cleaning tool comprising:

a housing of which a bottom side is adapted to face a floor;

a support element that is mounted to said housing and protrudes downwardly from said housing so as to contact on the floor and exert a first portion of a total contact force of said floor cleaning tool on the floor;

a power-driven rotatable brush roller that is rotatably mounted in said housing and exposed downwardly from said housing toward the floor;

a pivot lever that has a pivot point pivotally connected to said housing;

an adjusting element that is supported by and connected to a mounting point on said pivot lever displaced away from said pivot point of said pivot lever; and a biasing spring that is connected to said housing and to a spring connection point on said pivot lever displaced away from said pivot point of said pivot lever;

wherein said biasing spring exerts a biasing force that biases said pivot lever to pivot about said pivot point so as to move said adjusting element out of said housing to contact on the floor and exert a second portion of the total contact force of said floor cleaning tool on the floor; and wherein said brush roller selectively contacts on the floor and exerts a third portion of the total contact force of said floor cleaning tool on the floor, wherein said third portion is dependent on said second portion so as to be reduced by an increase of said second portion and to be increased by a reduction of said second portion, whereby an adjustment of said adjusting element adjusts said third portion of said total contact force exerted by said brush roller on the floor.

2. The floor cleaning tool according to claim 1, wherein said support element comprises at least one support roller that is rotatable mounted about a rotation axis that is fixed in said housing.

3. The floor cleaning tool according to claim 1, wherein said support element comprises at least one supporting glide element that is fixed to said housing.

4. The floor cleaning tool according to claim 1, wherein said adjusting element comprises at least one adjusting glide element that is non-rotatably connected to said mounting point on said pivot lever.

5. The floor cleaning tool according to claim 1, wherein said brush roller is rotatably mounted about a rotation axis that is fixed in said housing.

6. The floor cleaning tool according to claim 1, wherein said adjusting element is located between said brush roller and said support element, and closer to said brush roller than to said support element.

7. The floor cleaning tool according to claim 1, wherein said pivot point is at a pivoted end of said pivot lever.

8. The floor cleaning tool according to claim 1, wherein said mounting point at which said adjusting element is connected to said pivot lever is between said pivot point and said spring connection point.

9. The floor cleaning tool according to claim 1, wherein said pivot lever is an angled two-armed lever including first and second arms connected to each other at a vertex with an angle less than 180° between said first and second arms, and wherein said mounting point at which said adjusting element is connected to said pivot lever is located at said vertex.

10. A floor cleaning tool comprising:

a housing of which a bottom side is adapted to face a floor;

a support element that is mounted to said housing and protrudes downwardly from said housing so as to contact on the floor and exert a first portion of a total contact force of said floor cleaning tool on the floor;

a power-driven rotatable brush roller that is rotatably mounted in said housing and exposed downwardly from said housing toward the floor;

a pivot lever that has a pivot point pivotally connected to said housing;

an adjusting element that is supported by and connected to a mounting point on said pivot lever displaced away from said pivot point of said pivot lever; and a biasing spring that is connected to said housing and to a spring connection point on said pivot lever displaced away from said pivot paint of said pivot lever;

wherein said biasing spring exerts a biasing force that biases said pivot lever to pivot about said pivot point so as to move said adjusting element out of said housing to contact on the floor and exert a second portion of the total contact force of said floor cleaning tool on the floor;

further comprising an adjustable travel-limiting element that includes an adjustable counter-surface arranged in said housing adjacent to and cooperating with said pivot lever, and that is manually adjustable so as to selectively position said adjustable counter-surface at a selected position to limit an upward pivoting travel of said pivot lever against said adjustable counter-surface at said selected position.

11. The floor cleaning tool according to claim 10, wherein said travel-limiting element further includes a rotary knob that is rotatable about a knob rotation axis, wherein said adjustable counter-surface comprises plural stop surfaces that are connected to said rotary knob, and that extend parallel to said knob rotation axis, and that are respectively positioned at respective different spacing distances relative to said knob rotation axis, and wherein said different spacing distances define different positions of said plural stop surfaces among which said selected position is selected by rotation of said rotary knob.

12. A floor cleaning tool comprising:

a housing of which a bottom side is adapted to face a floor;

a support element that is mounted to said housing and protrudes downwardly from said housing so as to contact on the floor and exert a first portion of a total contact force of said floor cleaning tool on the floor;

a power-driven rotatable brush roller that is rotatably mounted in said housing and exposed downwardly from said housing toward the floor;

a pivot lever that has a pivot point pivotally connected to said housing;

an adjusting element that is supported by and connected to a mounting point on said pivot lever displaced away from said pivot point of said pivot lever; and a biasing spring that is connected to said housing and to a spring connection paint on said pivot lever displaced away from said pivot point of said pivot lever;

wherein said biasing spring exerts a biasing force that biases said pivot lever to pivot about said pivot point so as to move said adjusting element out of said housing to contact on the floor and exert a second portion of the total contact force of said floor cleaning tool on the floor;

further comprising an operating element and a coupling link that is connected to said operating element and to said pivot lever at a location displaced from said pivot point, whereby an operating movement of said operating element operates said coupling link to pivot said pivot lever so as to selectively move said adjusting element out of said housing to a maximally protruding position thereof which maximizes said second portion of the total contact force of said floor cleaning tool on the floor and lifts said brush roller out of contact with the floor into a parking position of said brush roller.

13. The floor cleaning tool according to claim 12, wherein said coupling link comprises a coupling rod that is form-fittingly connected to said pivot lever.

14. The floor cleaning tool according to claim 12, wherein said coupling link comprises a spring-loaded extensible rod or piston-cylinder element.

15. The floor cleaning tool according to claim 12, wherein said biasing spring is connected to said coupling link and via said coupling link to said spring connection point on said pivot lever.

16. A floor cleaning tool comprising:

a housing of which a bottom side is adapted to face a floor;

a support element that is mounted to said housing and protrudes downwardly from said housing so as to contact on the floor and exert a first portion of a total contact force of said floor cleaning tool on the floor;

a power-driven rotatable brush roller that is 9 rotatably mounted in said housing and exposed downwardly from said housing toward the floor;

a pivot lever that has a pivot point pivotally connected to said housing;

an adjusting element comprising at least one adjusting roller that is supported by and rotatably connected to a mounting point on said pivot lever displaced away from said pivot point of said pivot lever; and a biasing spring that is connected to said housing and to a spring connection point on said pivot lever displaced away from said pivot point of said pivot lever;

wherein said biasing spring exerts a biasing force that biases said pivot lever to pivot about said pivot point so as to move said adjusting element out of said housing to contact on the floor and exert a second portion of the total contact force of said floor cleaning tool on the floor.

17. A floor cleaning tool comprising:

a housing of which a bottom side is adapted to face a floor;

a support element that is mounted to said housing and protrudes downwardly from said housing so as to contact on the floor and exert a first portion of a total contact force of said floor cleaning tool on the floor;

a power-driven rotatable brush roller that is rotatably mounted in said housing and exposed downwardly from said housing toward the floor;

a pivot lever having a pivot point that is provided at a pivoted end of said pivot lever and that is pivotally connected to said housing;

an adjusting element that is supported by and connected to a mounting point on said pivot lever displaced away from said pivot point of said pivot lever; and a biasing spring that is connected to said housing and to a spring connection point on said pivot lever at a free end of said pivot lever opposite and away from said pivoted end and displaced away from said pivot point of said pivot lever;

wherein said biasing spring exerts a biasing force that biases said pivot lever to pivot about said pivot point so as to move said adjusting element out of said housing to contact on the floor and exert a second portion of the total contact force of said floor cleaning tool on the floor.

* * * * *

UNITED STATES PATENT AND TRADEMARK OFFICE

CERTIFICATE OF CORRECTION

PATENT NO. : 7,266,861 B2
APPLICATION NO. : 10/629067
DATED : September 11, 2007
INVENTOR(S) : Stein et al.

It is certified that error appears in the above-identified patent and that said Letters Patent is hereby corrected as shown below:

Column 7,
Line 3, before "mounted", replace "rotatable" by --rotatably--;
Line 47, before "of", replace "paint" by --point--;

Column 8,
Line 21, after "connection", replace "paint" by --point--;
Line 56, after "is", delete --9--.

Signed and Sealed this

Eleventh Day of November, 2008

JON W. DUDAS
*Director of the United States Patent and Trademark Office*